US008891336B2

(12) United States Patent
Khalil

(10) Patent No.: US 8,891,336 B2
(45) Date of Patent: Nov. 18, 2014

(54) CHILD BATHROOM REMINDER WITH PROGRAMMABLE VOICE MEMO

(76) Inventor: Husni Khalil, West Warwick, RI (US)

( * ) Notice: Subject to any disclaimer, the term of this patent is extended or adjusted under 35 U.S.C. 154(b) by 417 days.

(21) Appl. No.: 13/301,991

(22) Filed: Nov. 22, 2011

(65) Prior Publication Data

US 2013/0128704 A1 May 23, 2013

(51) Int. Cl.

| | |
|---|---|
| ***G04B 47/00*** | (2006.01) |
| ***G04F 1/00*** | (2006.01) |
| ***G04G 13/02*** | (2006.01) |

(52) U.S. Cl.

CPC ..... *G04G 13/026* (2013.01); *G04F 1/005* (2013.01)

USPC ..... 368/10; 368/109

(58) Field of Classification Search

CPC ..... G04G 13/02; G04F 1/005

USPC ..... 368/10, 107–109; 600/449

See application file for complete search history.

(56) References Cited

U.S. PATENT DOCUMENTS

| | | | | |
|---|---|---|---|---|
| 5,058,591 | A * | 10/1991 | Companion et al. | 600/449 |
| 6,072,384 | A * | 6/2000 | Baker | 340/309.7 |
| 7,376,051 | B2 * | 5/2008 | Rosen | 368/63 |
| 2002/0009018 | A1 * | 1/2002 | Patella | 368/108 |
| 2007/0058492 | A1 * | 3/2007 | Carley | 368/109 |
| 2007/0123778 | A1 * | 5/2007 | Kantorovich | 600/437 |
| 2008/0089184 | A1 * | 4/2008 | Palmer | 368/244 |

* cited by examiner

*Primary Examiner* — Vit W Miska

(74) *Attorney, Agent, or Firm* — Barlow, Josephs & Holmes, Ltd.

(57) ABSTRACT

A child bathroom reminder device that includes a programmable voice memo function to encourage the child is disclosed. The bathroom reminder device generally includes a speaker, a display, and a memory configured and arranged to store a voice recording therein. A timing circuit is further provided to count to a settable time parameter. A function button to allow setting the time parameter, an increment button to increment the time parameter and a decrement button to decrease the time parameter are provided. A display circuit is further provided to display the time parameter on the display. An audio circuit is provided to play the voice recording stored in the memory through the speaker when the time parameter is reached. The timing circuit is reset and begins counting to the time parameter again once the time parameter is reached.

9 Claims, 3 Drawing Sheets

CHILD BATHROOM REMINDER WITH PROGRAMMABLE VOICE MEMO

BACKGROUND OF THE INVENTION

1. Field of the Invention

The present patent document relates generally to child care and toilet training and more particularly to a device to remind children to go to the bathroom.

2. Background of the Related Art

Training a child to use the toilet is daunting task. Parents and caretakers of the child must constantly remind the child to go to the bathroom or they will have an "accident". Children that do have reminders become toilet trained earlier. But parents and caretakers are sometimes forget to note the last time the child went to the bathroom or are otherwise inconsistent about reminding the child to go to the bathroom. Therefore, there is need of a system or device to help parents, caretakers and children to remember to go to the bathroom.

SUMMARY OF THE INVENTION

The present invention solves the problems of the prior art by providing a child bathroom reminder device that includes a programmable voice memo function to encourage the child. The bathroom reminder device generally includes a speaker, a display, and a memory configured and arranged to store a voice recording therein. A timing circuit is further provided to count to a settable time parameter.

A function button to allow setting the time parameter, an increment button to increment the time parameter and a decrement button to decrease the time parameter are further provided.

A display circuit is further provided to display the time parameter on the display. An audio circuit is provided to play the voice recording stored in the memory through the speaker when the time parameter is reached. The timing circuit is reset and begins counting to the time parameter again once the time parameter is reached.

BRIEF DESCRIPTION OF THE DRAWINGS

These and other features, aspects, and advantages of the present invention will become better understood with reference to the following description, appended claims, and accompanying drawings where:

DESCRIPTION OF THE PREFERRED EMBODIMENT

Referring now to FIGS. 1-4, the child bathroom reminder device of the present invention is shown generally at 10. The device 10 includes a housing 12, with a speaker 14 located on the front of the housing, although other location may be used.

Figure 1:
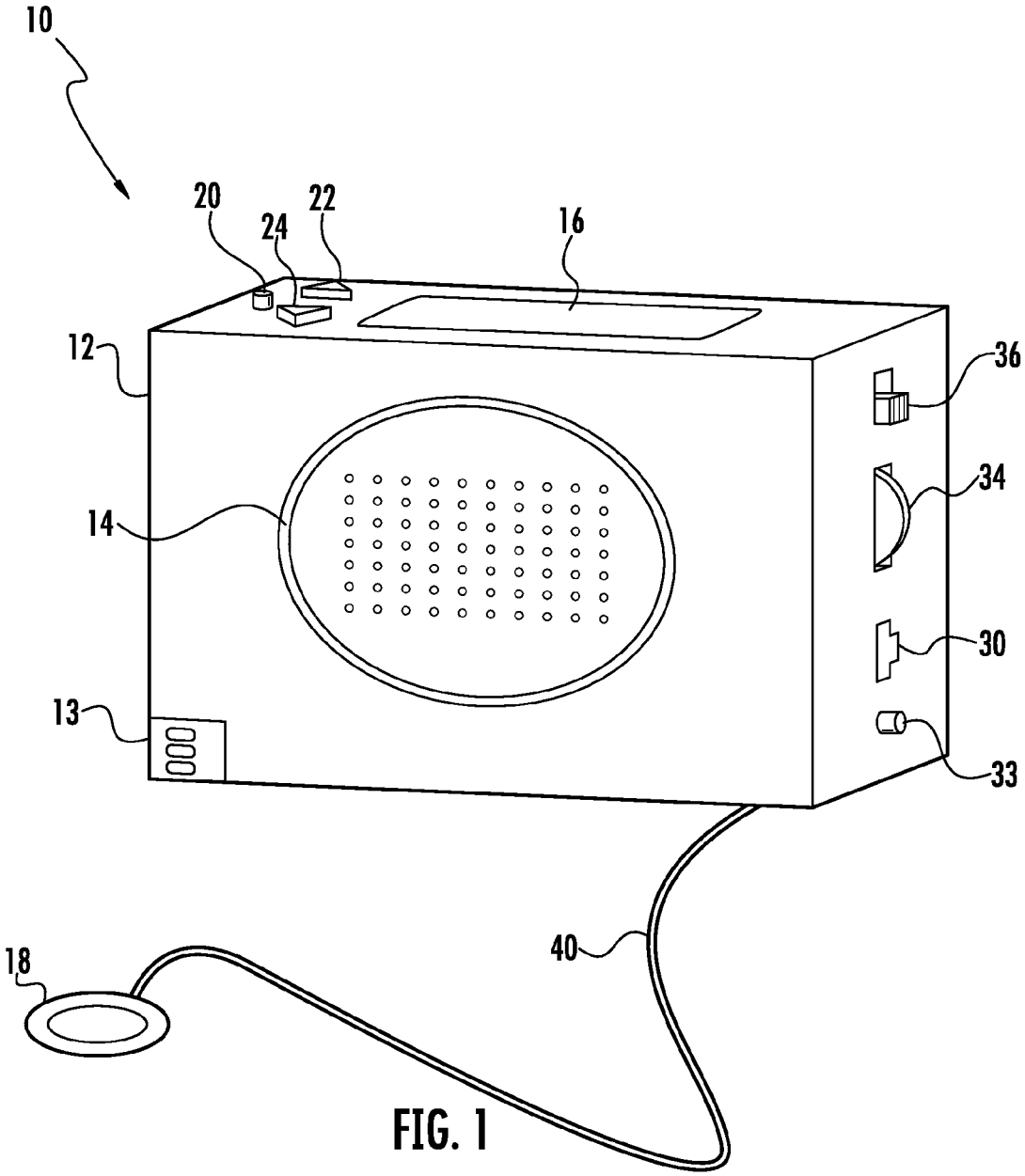
FIG. 1 is a front perspective view of a preferred embodiment of the child bathroom reminder of the present invention.
Figure 2:
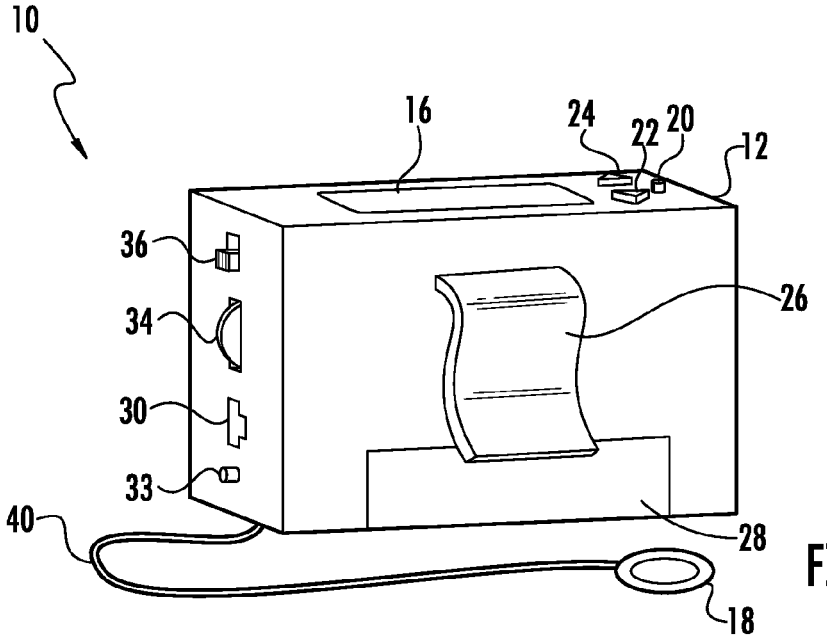
FIG. 2 is a rear perspective view of the preferred embodiment of the child bathroom reminder of the present invention.
Figure 3:
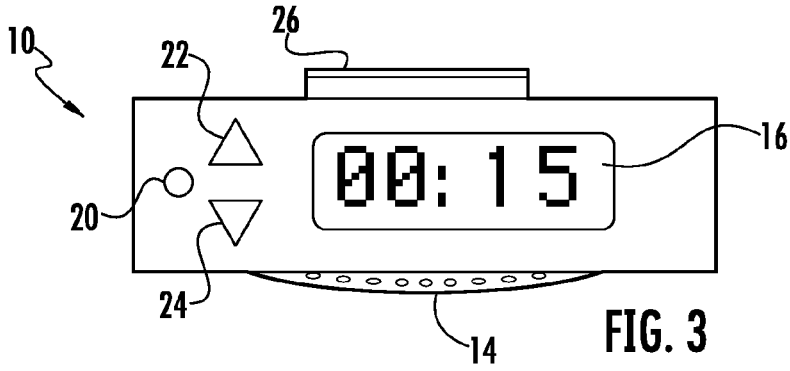
FIG. 3 is a top view of the preferred embodiment of the child bathroom reminder of the present invention.
Figure 4:
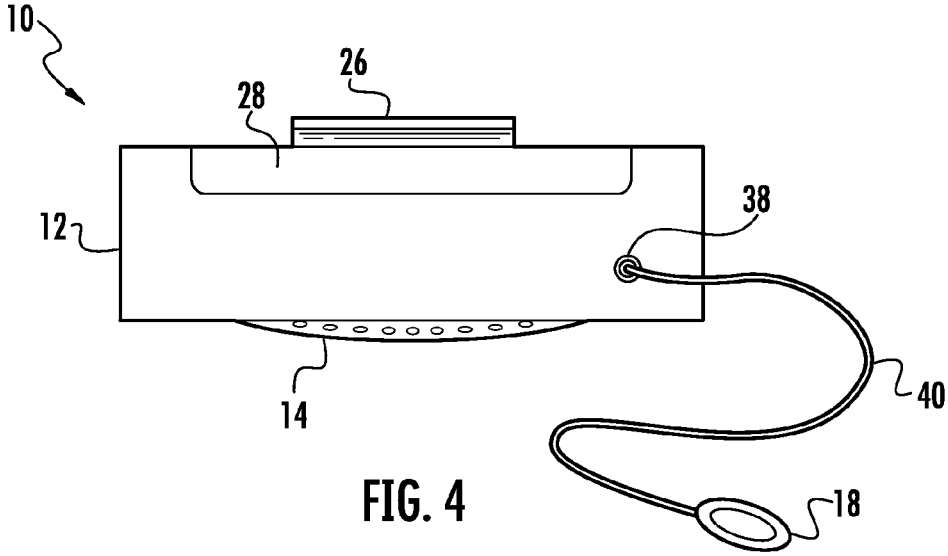
FIG. 4 is a bottom view of the preferred embodiment of the child bathroom reminder of the present invention.

On the top portion of the housing 12, best seen in FIG. 3, a display 16 is provided to show the current time remaining and to provide a visual indication while setting the time parameter and/or set the threshold level of a sensor 18, described further below. Adjacent to the display 16, is a function button 20 to allow setting the time parameter and threshold level of the sensor, an increment button 22 to increment the time parameter and/or threshold level, and a decrement button 24 to decrease the time parameter and/or threshold level. The buttons 20, 22, 24 are located on the top portion of the housing 12 adjacent to the display 16, but may be positioned elsewhere on the device 10. A microphone 13 may be included on the front portion of the housing 12 in order to permit a voice recording to be made on the device 10 without using a personal computer.

The rear portion of the housing 12 may include an optional clip 26 to attach the device 10 to a child's clothing or belt. A battery compartment cover 28 is provided for access to change one or more batteries for the device 10.

The right portion of the housing 12, includes a data port 30 to download and stored a voice memo in a memory 32, described further below. A record button 33 may also be included to activate the microphone 13 to record a voice memo to the memory 32 also. An optional volume control 34 may be provided to control the speaker 14 level. A power switch 36 may also be provided to turn the device 10 off when not in use. The data port 30, volume control 32, and power switch 34 may be located on other portions of the housing 12.

The bottom portion of the housing 12 includes a sensor jack 38 to permit attached the cable (or wire) 40 of a sensor 18 to the device 10, which is described further below.

Figure 5:
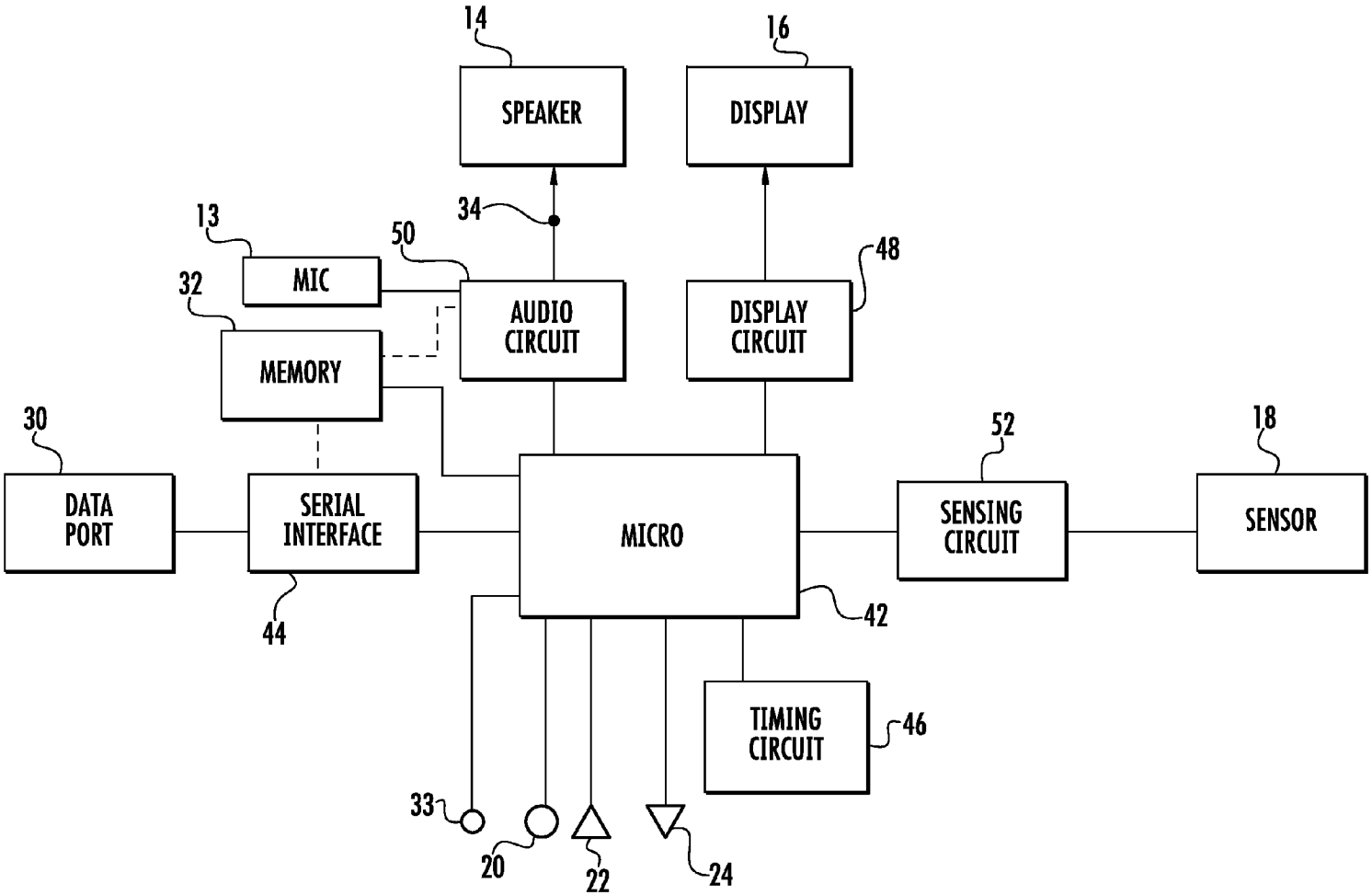
FIG. 5 is a schematic diagram of the operation of the preferred embodiment of the child bathroom reminder of the present invention.

Referring to FIG. 5, the device 10 includes a microprocessor 42. The microprocessor 42 is connected to a serial interface controller 44, such as a universal serial bus controller, which is connected to the data port 30, to permit the device 10 to communicate with a personal computer. The device 10 also has the memory 32, an audio circuit 50, sensing circuit 52, display circuit 48, and timing circuit 46 connected to the microprocessor 42 as well, which will be further described below.

The memory 32 is connected to microprocessor 42. A voice recording may be downloaded from the personal computer and stored in the memory 42. The memory 32 may be optionally connected to the serial interface controller 44 directly, as well, to permit a direct transfer to the memory 32 that bypasses the microprocessor 42. The serial interface controller 44 may be integrated with the microprocessor 42 as well.

The timing circuit 46 is further provided to count to a settable time parameter. The timing circuit 46 is connected to the microprocessor 42 or may be integrated therein. The time parameter is maintained by the microprocessor 42 and is set by holding the function button 20 momentarily. Pushing the increment button 22 increases the time parameter and pushing the decrement button 24 decreases the time parameter. The buttons 20, 22, 24 are connected to the microprocessor 42, which receives the button pushes and sets the time parameter as desired. The microprocessor 42 receives a signal from the timing circuit 44 which it compares to the time parameter to determine if the time parameter has been met. If the time parameter has been met the microprocessor 42 triggers an audio circuit 50 to play the voice recording stored in the memory 32.

The function button 20 may also be pushed twice to set the threshold level of the sensing circuit 52. The threshold level is also maintained by the microprocessor 42. In this mode, pushing the increment button 22 increases the threshold level and pushing the decrement button 24 decreases the threshold level of the sensing circuit 52. The microprocessor 42 receives a signal from the sensing circuit 52 which it compares to the threshold level to determine if the threshold level has been met. If the threshold level has been met the microprocessor 42 triggers the audio circuit 50 to play the voice recording stored in the memory 32 and resets the count of the timing circuit 46. The threshold level, for ease of use, may be set to 25%, 50%, 75%, and 100% bladder capacity, but other values or increments may be used.

The threshold level and/or time parameter may be stored in the memory 32 or internally in the microprocessor 42.

The display circuit 48 is further connected to the microprocessor 42 to display the time parameter or the threshold level stored by the microprocessor 42 on the display 16 to permit the user to easily see the value of the time parameter and/or threshold level. The display circuit 48 may be integrated into the microprocessor 42. When not in a mode setting the threshold level or time parameter, the display circuit 48 shows the value of the timing circuit 46, thereby provided information on when the last bathroom reminder was made or how much time remains to the next reminder, as desired.

The audio circuit 50 is connected to the microprocessor 42 to play the voice recording stored in the memory 32 through the speaker 14 when the time parameter and/or threshold level is reached. The audio circuit 50 may also be directly connected to the memory 32. The audio circuit 50 also activates the microphone 13 when the record button 33 is pressed in order to record from the microphone 13 to the memory 32. The microprocessor 42 detects the button press of the record button 33 and activates the audio circuit 50 to record from the microphone 13. The audio circuit 50 may also be integrated into the microprocessor 42.

The sensing circuit 52 constantly polls a sensor 18 which is connected to the sensing circuit 52 via a cable (or wire) 40 through a sensor jack 38 on the bottom portion of the housing 12. The sensor 18 is positioned on the child's abdomen in an optimal position to detect the fluid level in the child's bladder. The sensor 18 detects the fluid level in the child's bladder via ultrasound, ultrasonic and infrared techniques, or a combination thereof.

Therefore, it can be seen that the present invention provides a unique solution to the problem of regularly and consistently reminding a child to go to the bathroom. The device of the present invention also uniquely includes the ability to store a voice recording, such as from a parent, to provide added encouragement to the child.

It would be appreciated by those skilled in the art that various changes and modifications can be made to the illustrated embodiments without departing from the spirit of the present invention. All such modifications and changes are intended to be within the scope of the present invention except as limited by the scope of the appended claims.

What is claimed is:

1. A bathroom reminder device, comprising:

a speaker;

a display;

a memory configured and arranged to store a voice recording therein;

a timing circuit configured and arranged to count to a settable time parameter;

a display circuit configured and arranged to display the time parameter on the display;

an audio circuit configured and arranged to play the voice recording stored in the memory through the speaker when the time parameter is reached, whereby the timing circuit is reset and begins counting to the time parameter again; and a sensor configured and arranged to attach to an abdomen of a person, the sensor connected to a sensing circuit, the sensing circuit configured and arranged to detect a bladder level of the person, and the audio circuit further configured and arranged to play the voice recording stored in the memory through the speaker when a threshold level has been reached, whereby the timing circuit is reset and begins counting to the time parameter again.

2. The device of claim 1, further comprising a function button to allow setting the time parameter, an increment button to increment the time parameter, and a decrement button to decrease the time parameter.

3. The device of claim 1, further comprising a data port for downloading a prerecorded voice recording to the memory.

4. The device of claim 1, wherein said function button is further configured and arranged to allow setting the threshold level of the sensing circuit, the increment button is further configured and arranged to increase the threshold level, and the decrement button is further configured and arranged to decrease the threshold level of the sensing circuit.

5. The device of claim 4, wherein said threshold level is settable to 25%, 50%, 75%, and 100%.

6. The device of claim 1, wherein said sensor is selected form the group consisting essentially of ultrasound, ultrasonic, and infrared.

7. The device of claim 1, further comprising a volume control to set a volume level of the speaker.

8. The device of claim 1, further comprising a compact housing for wearing on a person.

9. The device of claim 1, further comprising a clip extending from the housing.

* * * * *